United States Patent [19]

Sullivan

[11] Patent Number: 4,914,918

[45] Date of Patent: Apr. 10, 1990

[54] COMBUSTOR SEGMENTED DEFLECTOR

[75] Inventor: Dennis J. Sullivan, Vernon, Conn.

[73] Assignee: United Technologies Corporation, Hartford, Conn.

[21] Appl. No.: 248,676

[22] Filed: Sep. 26, 1988

[51] Int. Cl.[4] ..... F23R 3/00

[52] U.S. Cl. ..... 60/756; 60/39.32

[58] Field of Search ..... 60/39.32, 740, 752, 60/755, 756; 431/350, 351

[56] References Cited

U.S. PATENT DOCUMENTS 4,322,945 4/1982 Peterson et al. ..... 60/756

4,365,470 12/1982 Matthews et al. ..... 60/39.32

4,686,823 8/1987 Coburn et al. ..... 60/752

4,766,722 8/1988 Bayle-Laboure et al. ..... 60/752

*Primary Examiner*—Louis J. Casaregola

*Assistant Examiner*—Timothy S. Thorpe

*Attorney, Agent, or Firm*—Edward L. Kochey, Jr.

[57] ABSTRACT

A deflector assembly (20) includes an annular plate portion (28) with pairs of parallel substantially radial slots (30). Truncated pie shaped segments (34) are secured (32, 36) to the plate with cooling air (40, 52) directed between the segments and the plate. Extended cooling surface (48) increases the cooling effect of the airflow. The segments are free from thermal fight and direct the discharged cooling air to help cool the remaining exposed bulkhead surface or shield.

11 Claims, 3 Drawing Sheets

COMBUSTOR SEGMENTED DEFLECTOR

TECHNICAL FIELD

The invention relates to gas turbine engine combustors and in particular to thermal shielding therein.

BACKGROUND OF THE INVENTION

Combustor chambers of gas turbine engines receive their air supply from an air supply chamber separated from the combustor chamber by a bulkhead. Such gas turbine annular combustors are typically formed with liners on the sides and a bulkhead at the forward end. Fuel injectors are located within each of a plurality of openings in the bulkhead and arranged to inject fuel into the combustor for combustion therein. A deflector assembly closes the opening between the fuel injector and the bulkhead in a manner to deflect air flow therethrough in a desired manner. Such deflector is usually slideably mounted to the bulkhead in a radial direction with respect to the injector axis, and slideably accepts the fuel injector in the axial direction. This allows for a reasonable degree of misalignment between the injector and the bulkhead.

Flame existing immediately downstream of the injector radiates intensely toward the bulkhead in all areas.

Accordingly, a radiation shield is normally desirable immediately around the injector.

Annular plates have been formed on the deflector extending radially parallel to the bulkhead for the purpose of providing a radiation shield. These annular plates have been a chronic durability problem commonly experiencing burning distortion or cracking. These plates not only experience high temperatures but experience temperature differentials at different radial locations. Since the shields have been a single annular plate, a thermal fight is established between the hot outer rim and the cooler inner portion. The hot outer portion tries to expand as a function of its temperature but is constrained by the cool inner rim which expands to a lesser extent. This enforces a stress leading toward buckling and cracking of the material which is already operating at an extremely high temperature.

Since the material forming the annular plate must be fabricated into the annular shape and tolerate the high differential temperatures and concommitant stresses, the choice of materials is somewhat limited. For instance low ductility material such as ceramics and cast turbine alloys cannot conveniently be used.

It would be desirable to have a deflector heat shield which is not subject to the thermal fight of the current heat shields, which permits selection of materials more tolerant of high temperatures, and which can be reasonably cooled and easily fabricated.

SUMMARY OF THE INVENTION

The invention is used in a gas turbine having a combustor including a bulkhead interposed between an air supply chamber and the combustor chamber. There is at least one opening through the bulkhead with a fuel injector located in each opening and arranged to inject fuel into the combustor.

The heat shield deflector assembly includes a deflector base slideably secured to the bulkhead within the opening, and surrounding the fuel injector. The base has an annular plate portion extending radially outward from the fuel injector and is substantially parallel to the bulkhead while located within the combustor. A plurality of circumferentially divided heat shield segments are secured to this annular plate portion and located on the combustor side of it. Retention means for axially restraining each segment to the annular plate portion are preferably T-shaped lugs on each segment which engage radially extending slots in the annular plate portion.

A segment keeper comprises a ring surrounding the T lugs located between the annular plate and the bulkhead which is welded into place after the segments are slid into the slots.

Air cooling openings are directed into the space behind the heat shield segments with the heat shield segments having extended cooling surface on the rear side thereof. Such cooling surface is preferably in the form of radially extending wedge shaped extensions forming uniform flowpaths therebetween. Each segment is formed to have substantial contact with the annular plate at the inner radial edge and at the outer radially extending portions thereof, so that cooling air is directed radially outward behind the heat shield segments.

DESCRIPTION OF THE PREFERRED EMBODIMENT

Figure 1:
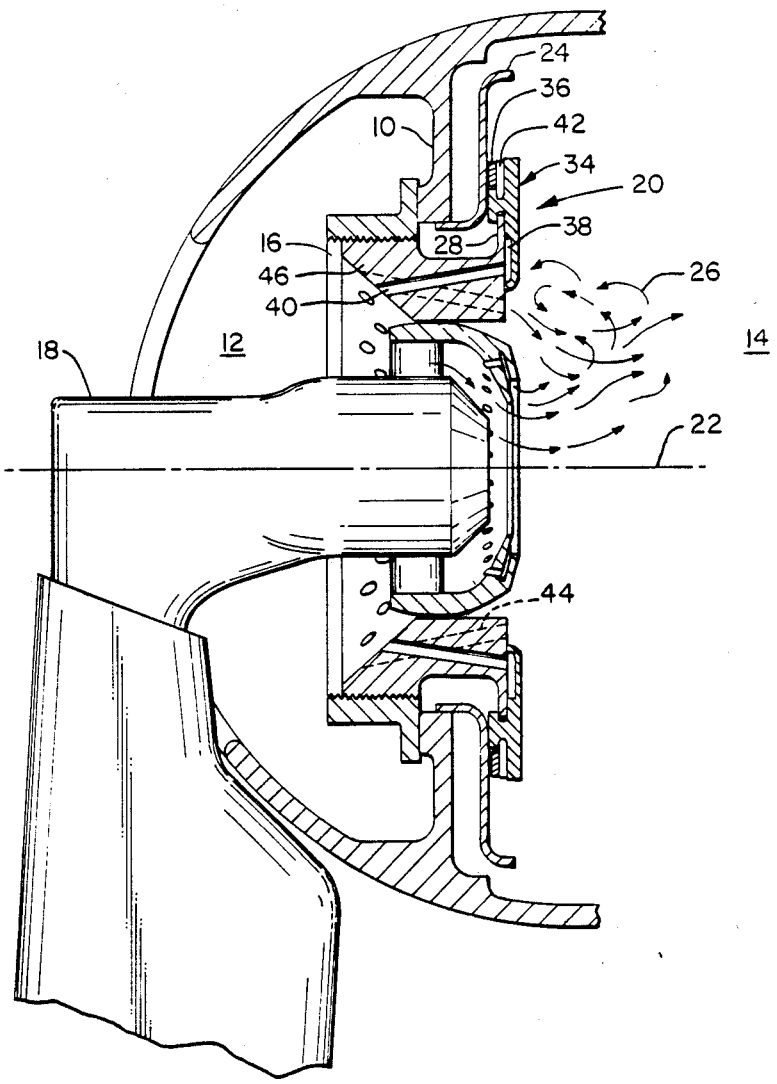
FIG. 1 is a sectional view of the deflector assembly as installed.

In the gas turbine engine a bulkhead 10 is interposed between an air supply chamber 12 and a combustor chamber 14. A plurality of openings 16 are located in the bulkhead with a fuel injector 18 located in each opening. A deflector assembly 20 is slidingly secured to the bulkhead and surrounds fuel injector 18 to appropriately deflect air therearound. A flame is established in combustor chamber 14 generally coaxial with axis 22 downstream of the fuel injector.

A backup heat shield 24 may be located on the combustor side of bulkhead 10 for the purpose of reducing the general radiation from the flame in the combustor to the bulkhead. In a conventional manner air cooling may be supplied behind this heat shield.

Because of the intense local radiation adjacent to the flame and because of recirculating hot gases 26 a heat shield is desirable adjacent to the fuel injector.

Accordingly, deflector assembly 20 has a radially extending annular plate portion 28 extending outwardly from the fuel injector and substantially parallel to the bulkhead 10 at a location within the combustor. Substantially radially extending but parallel slots 30 extend to the outer edge of the annular plate and receive T lugs 32 located on each of the heat shield segments 34. A segment keeper in the form of ring 36 is put in place after the segments 34 have been slid into slots 30. The keeper is then welded to plate portion 28. This ring functions to retain the segments within the slots.

Between each segment 34 and the annular plate 28 is an air space 38. Air supply opening 40 through the deflector assembly is in fluid communication with air supply chamber 12 and delivers cooling air into air space 38. This cooling air convectively cools the rear surface of each segment 34 exiting through opening 42. Conventional airflow openings 44 are also located in the deflector assembly for the purpose of providing some combustion air to the flame and also aiding in cooling the base 46 of deflector assembly 20.

Figure 3:
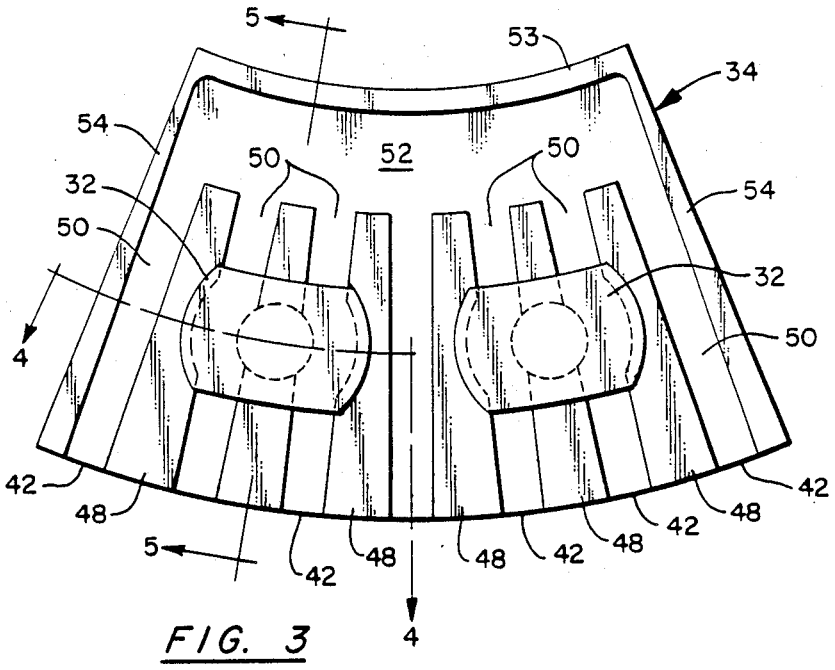
FIG. 3 is a view of the rear side of a heat shield segment.
Figure 4:
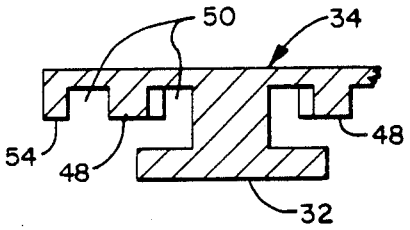
FIG. 4 is section 4—4 through the heat shield segment.
Figure 5:
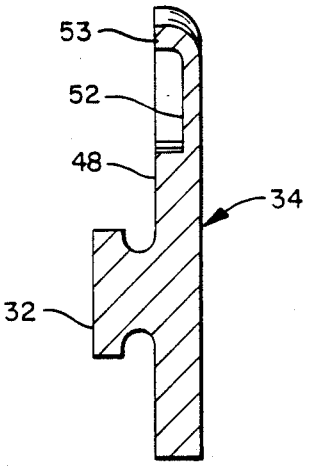
FIG. 5 is section 5—5 through the heat shield segment.

Each segment 34 is of truncated pie shape with eight of the segments located around the annular plate 28. The form of these truncated pie shape segments is best seen in FIGS. 3, 4 and 5. Wedge shaped extended cooling surface (48) on the rear side of each segment provide a plurality of radial air passages in the form of airflow slots 50 of substantially uniform flow area. The recessed area 52 of each wedge receives cooling air from openings 40 with the air flowing radially outward through slots 50 and discharging into the combustion chamber.

Each segment has an inner lip 53 at the radially inward edge of the segment which is in substantial contact with annular plate 28. This minimizes leakage of cooling air radially inward toward the flame which would not only decrease the air available for cooling of the segments, but could tend to dilute the air fuel concentration in the flame area tending to increase lean blowout problems.

Each segment also has a radially elongated edge lip 54 in substantial contact with annular plate 28 which minimizes air leakage outwardly under the segments. This induces the full cooling flow to flow radially outwardly through the cooling openings 50.

Figure 2:
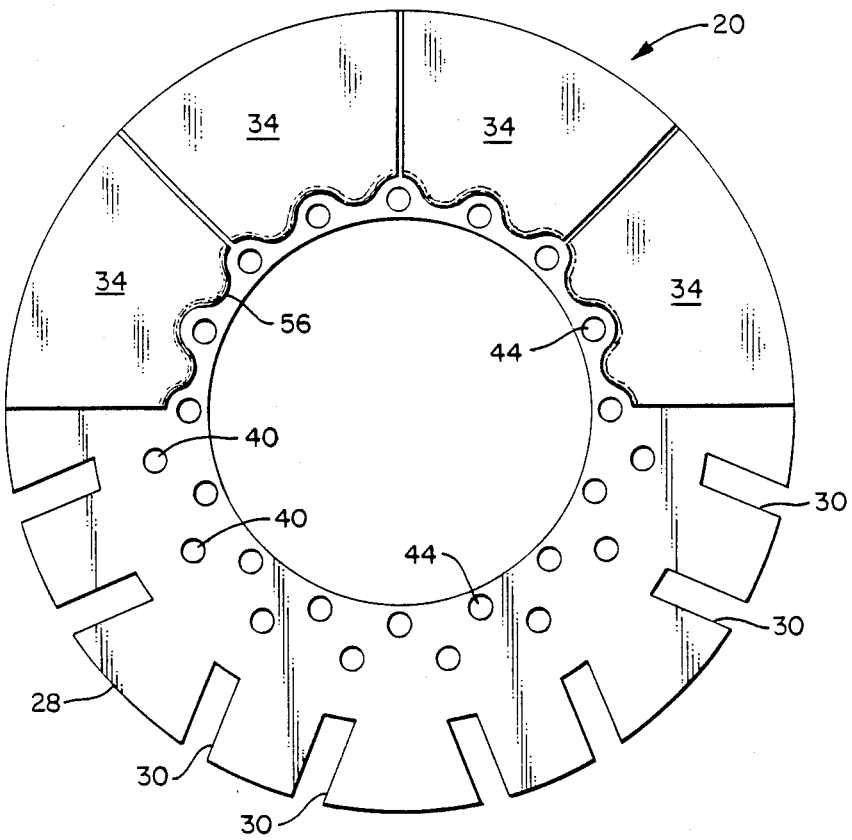
FIG. 2 is a front view of the deflector assembly from the combustor side with the segmented shield segments shown in the upper half and removed in the lower half.

The inner edge and lip 53 of each segment may be of sinuous form 56 as shown in FIG. 2. This permits the diameter of the two concentric rings of holes (cooling air supply holes 40 and combustion air holes 44) to be located as close as possible to each other. The amount of the deflector base 20 which is uncooled is thereby minimized.

The cooling flowpath is such as to significantly cool not only the inner edge of each segment but also the outer portion. The segments permit expansion without significant stress. However, even if the outer portion should become significantly hotter than the inner portion the segments permit expansion without significant stress. Even nominal fabrication tolerance between the segments is sufficient to permit the thermal growth without establishing stress within the material. Each segment being free to deform in accordance with its own temperature pattern minimizes the stresses and accordingly the cracking and buckling of the heat shield.

Each segment may be of a high temperature alloy such as a cast nickel based alloy and if desired may be coated with a thermal barrier coating on the combustor side.

Alternately the segments may be formed a ceramic such as silicon nitride which while having lower thermal conductivity is tolerant of higher temperatures. Since thermal fight stresses are minimized even relatively brittle material is acceptable in this arrangement.

While the extended heat transfer surface on the reverse side of the segments may be in the form of pins, study has suggested that the radially extending wedges provide more uniform and more predictable heat transfer situation.

I claim:

1. In a gas turbine engine including a combustor, a bulkhead interposed between an air supply chamber and said combustor, at least one opening through said bulkhead, a fuel injector located in said opening and arranged to inject fuel into said combustor, a heat shielded deflector assembly comprising:

a deflector base secured to said bulkhead within said opening and surrounding said fuel injector;

said base having an annular plate portion extending radially outward from said fuel injector and substantially parallel to said bulkhead within said combustor;

a plurality of circumferentially divided heat shield segments secured to said annular plate portion and located on the combustor side thereof; and retention means for axially restraining each segment to said annular plate portion.

2. A heat shielded deflector assembly as in claim 1, said retention means comprising:

at least one substantially radially extending slot in said annular plate portion extending to the outer edge thereof for each heat shield segment; and at least one T-shaped lug on each segment engaging said slot.

3. A heat shielded deflector assembly as in claim 2, said retention means comprising:

a plurality of parallel substantially radially extending slots in said annular plate portion extending to the outer edge thereof for each heat shield segment; and a plurality of T-shaped lugs on each segment engaging said plurality of slots.

4. A heat shielded deflector assembly as in claim 2, having also:

a segment keeper comprising a ring located between said annular plate portion and said bulkhead and circumferentially surrounding at least a portion of each T-shaped lug.

5. A heat shielded deflector assembly as in claim 3, having also:

a segment keeper comprising a ring located between said annular plate portion and said bulkhead and circumferentially surrounding at least a portion of each T-shaped lug.

6. A heat shielded deflector assembly as in claim 1:

said segments secured with an air space between each segment and said annular plate;

an air supply opening through said deflector base in fluid communication with said air chamber and with said air space behind each segment; and air passages between each of said segments and said annular plate for discharging air from said air space.

7. A heat shielded deflector assembly as in claim 6:

said segments each having an inner lip along the radially inward edge in substantial contact with said annular plate; and said air supply opening in fluid communication with said air space adjacent to said inner lip.

8. A heat shielded deflector assembly as in claim 7:

each segment having on the surface facing said annular plate extended heat transfer surface extending into said air space.

9. A heat shielded deflector assembly as in claim 8:

said extended heat transfer surface comprising longitudinal ridges.

10. A heat shielded deflector assembly as in claim 9:

said longitudinal ridges being wedge shaped to an extent which provides uniform space and flow area between said ridges throughout the radial length of said ridges.

11. A heat shielded deflector assembly as in claim 10: each segment having a radially elongated edge lip on each radial edge of said segment in substantial contact with said annular plate.

* * * * *